US009010026B2

(12) United States Patent
Murray et al.

(10) Patent No.: US 9,010,026 B2
(45) Date of Patent: Apr. 21, 2015

(54) DRIVEN MEMBER POSITIONER

(71) Applicant: The Chamberlain Group, Inc., Elmhurst, IL (US)

(72) Inventors: James Scott Murray, Glendale Heights, IL (US); William George Gioia, Lindenhurst, IL (US)

(73) Assignee: The Chamberlain Group, Inc., Elmhurst, IL (US)

( * ) Notice: Subject to any disclaimer, the term of this patent is extended or adjusted under 35 U.S.C. 154(b) by 0 days.

(21) Appl. No.: 14/258,474

(22) Filed: Apr. 22, 2014

(65) Prior Publication Data

US 2014/0223825 A1 Aug. 14, 2014

Related U.S. Application Data

(62) Division of application No. 12/886,170, filed on Sep. 20, 2010, now Pat. No. 8,707,627.

(51) Int. Cl.
*E06B 3/00* (2006.01)
*E06B 11/04* (2006.01)

(52) U.S. Cl.
CPC ..... *E06B 11/045* (2013.01); *E05F 15/643* (2013.01); *E05F 15/79* (2013.01); *E05Y 2201/656* (2013.01); *E05Y 2201/668* (2013.01); *E05Y 2201/672* (2013.01); *E05Y 2400/326* (2013.01); *E05Y 2800/21* (2013.01); *E05Y 2900/40* (2013.01)

(58) Field of Classification Search
USPC ..... 49/506, 324, 360
See application file for complete search history.

(56) References Cited

U.S. PATENT DOCUMENTS

| | | | |
|---|---|---|---|
| 3,262,651 | A | 7/1966 | Henderson et al. |
| 3,762,524 | A | 10/1973 | Anderson |
| 3,775,906 | A | 12/1973 | Dougherty |
| 5,530,535 | A | 6/1996 | Matsuoka |
| 5,640,072 | A | 6/1997 | Miyazaki |
| 6,092,338 | A | 7/2000 | Crowner et al. |
| 6,108,977 | A | 8/2000 | Payne |
| 6,246,195 | B1 | 6/2001 | Kloesters |
| 6,400,112 | B1 | 6/2002 | Fitzgibbon et al. |
| 6,414,454 | B1 | 7/2002 | Lhotak |
| 6,695,130 | B1 | 2/2004 | Blaylock et al. |
| 6,848,556 | B2 | 2/2005 | Chen et al. |
| 7,164,246 | B2 | 1/2007 | Fitzgibbon et al. |
| 2003/0046872 | A1 | 3/2003 | Fukumura |
| 2009/0189560 | A1 | 7/2009 | Taheri |
| 2010/0024308 | A1 | 2/2010 | Coubray |

*Primary Examiner* — Gregory J. Strimbu
(74) *Attorney, Agent, or Firm* — Fitch Even Tabin & Flannery LLP

(57) ABSTRACT

In one aspect, a method of operating a movable barrier operator includes engaging a flexible driven member with a drive of the movable barrier operator. The method includes moving the flexible driven member in a first direction to move a movable barrier connected to the driven member and monitoring the position of the movable barrier. In response to the movable barrier reaching a given position, the driven member is moved in a second direction without moving the movable barrier to remove slack from the driven member. A movable barrier apparatus includes a movable barrier controller operatively coupled to the movable barrier operator. The movable barrier controller is configured to cause the movable barrier operator to reverse direction of the flexible driven member a distance after stopping movement of the movable barrier without moving the movable barrier.

19 Claims, 6 Drawing Sheets

DRIVEN MEMBER POSITIONER

RELATED APPLICATION

This is a divisional application of U.S. patent application Ser. No. 12/886,170 filed Sep. 20, 2010, now U.S. Pat. No. 8,707,627, which is incorporated by reference in its entirety herein.

FIELD

The present application relates generally to movable barrier operators and, more particularly, to movable barrier operators that utilize flexible driven members to move associated movable barriers.

BACKGROUND

Movable barrier operators may be used to control access to areas by moving movable barriers between different positions. Various types of movable barriers can be moved in such a fashion, including vertically moving barriers such as single piece and segmented barriers as well as horizontally moving barriers such as sliding and swinging gates.

A movable barrier operator may have a motive source, such as a motor system, to produce movement of a movable barrier. More particularly, the motor system may have a wheel, pulley, or sprocket that engages a flexible driven member connected to the movable barrier and moves the driven member to adjust the position of the movable barrier. In one approach, the driven member is a long chain and the motor system has a drive gear that engages the chain. The chain is connected to the movable barrier such that rotating the drive gear moves the chain and the attached movable barrier. The movable barrier operator controls the rotation of the drive gear to move the movable barrier between a full-open position and a full-closed position. In a second approach the driven member is a belt and the motor system has a drive pulley that engages the belt. The belt is connected to the movable barrier such that rotating the drive pulley moves the belt and the attached movable barrier. As with the first approach, the movable barrier operator controls the rotation of the drive pulley to move the movable barrier between a full-open position and a full-closed position.

One shortcoming to using a flexible driven member is that when the movable barrier is at either the full-open or the full-closed position, there will be a long segment of the flexible driven member that sags downwardly due to the effect of gravity on the driven member. The appearance of the long sagging segment of the flexible driven member may be visually unappealing for certain applications. Also, the appearance of the flexible driven member sagging may be considered a sign of an improper installation. In this instance, an installer may be tempted to over-tighten the flexible driven member in order to reduce sag, which may cause undo wear on the system.

Further, the flexible drive member may gradually stretch over time such that an acceptable amount of sag at installation may increase and eventually become unacceptable to the owner of the movable barrier operator. If the flexible drive member is a chain, the chain may have hinge points that loosen over time and gradually increase in length. Similarly, belts have a tendency to increase in length over their lifetime due to stretching Another shortcoming of prior movable barrier operators is that the sagging segment of chain allows the motor to speed up prior to having to pull the barrier. When the drive gear begins to rotate, the sagging segment will first be tensioned to remove the sag before the barrier is moved. This is due to the low amount of force needed to remove the tension. Once the sag is removed the operator will have to overcome the inertia of the barrier requiring a much higher force. This creates an impact force on the movable barrier operator which may damage the movable barrier operator, the flexible drive member, and the movable barrier.

SUMMARY

In accordance with one aspect, a method of operating a movable barrier operator is provided that includes engaging a revolving drive of the movable barrier operator between leading and trailing portions of a flexible driven member connected to a movable barrier. The revolving drive is configured to rotate about an axis with the leading portion of the driven member being initially paid out from the axis and the trailing portion of the driven member being pulled toward the axis as the revolving drive rotates about the axis.

The movable barrier is moved by moving the leading portion of the driven member away from the revolving drive while moving the trailing portion of the driven member toward the revolving drive. The method includes suspending movement of the movable barrier in response to the movable barrier arriving at a stopping point. The stopping point may be, for example, a full-closed position of the movable barrier wherein the leading portion of the driven member sags downwardly a greater amount than the trailing portion of the driven member. After suspending movement of the movable barrier, the method further calls for moving the leading portion of the driven member toward the revolving drive while moving the trailing portion of the driven member away from the revolving drive without moving the movable barrier. In this manner, moving the leading portion of the driven member back toward the revolving drive may reduce the slack in the leading portion of the driven member and improve the overall appearance of the driven member when the movable barrier is positioned at the stopping point.

In another aspect, a movable barrier apparatus is provided including a movable barrier configured to move between a first limit position and a second limit position. The apparatus further includes a flexible driven member having a pair of end portions configured to connect to the movable barrier and a movable barrier operator disposed between the end portions of the driven member. The movable barrier operator is configured to selectively move the driven member in a forward direction to move the movable barrier toward the first limit position as well as move the driven member in an opposite, reverse direction to move the movable barrier toward the second limit position. A movable barrier controller is operatively coupled to the movable barrier operator, the movable barrier controller being configured to cause the movable barrier operator to move the driven member in the reverse direction without moving the movable barrier. More particularly, the movable barrier controller causes the movable barrier operator to shift the driven member in the reverse direction a given distance after stopping movement of the movable barrier toward the first limit position. By reversing the driven member a given distance after stopping movement of the movable barrier, the movable barrier controller may remove slack from the driven member and compensate for changes to the length of the driven member over time.

There are a number of different approaches to determine when to move the driven member the given distance, including using a limit position sensor to sense when the movable barrier reaches the first limit position. In this approach, the movable barrier operator is configured to shift the driven member in the reverse direction in response to the limit position sensor detecting that the movable barrier reaches the first limit position. In another approach, the movable barrier apparatus includes a revolving drive that engages the driven member, a position sensor for detecting the position of the revolving drive, and a movable barrier controller that is operatively coupled to the revolving drive and the position sensor. The movable barrier controller is configured to calculate the position of the movable barrier in response to information from the position sensor. In this manner, the movable barrier controller may cause the movable barrier operator to move the driven member in the reverse direction the given distance in response to the movable barrier controller determining that the revolving drive has moved the movable barrier to the first limit position.

In accordance with another aspect, a method of operating a movable barrier operator is provided that includes engaging a revolving drive of the movable barrier operator with a flexible driven member. The driven member is moved in a first direction to move a movable barrier connected to the driven member. The method calls for monitoring a position of the movable barrier and suspending movement of the driven member in response to the movable barrier reaching a given position. The method further calls for moving the driven member in a second direction without moving the movable barrier. Moving the driven member in the second direction pretensions the driven member between the revolving drive of the movable barrier operator and a connection between the driven member and the movable barrier. Pretensioning the driven member permits a consistent engagement between the driven member and the revolving drive, which reduces start-up impact on the movable barrier operator and the driven member. Pretensioning the driven member will also reduce the appearance of chain sag in a given approach.

BRIEF DESCRIPTION OF THE DRAWINGS

FIGS. 3A-3D are a series of front elevational views of a movable barrier illustrating an example of the method of FIG. 2 applied to the movable barrier wherein FIG. 3A is a front elevational view of a movable barrier during an opening operation, FIG. 3B is a front elevational view of a movable barrier during a closing operation, FIG. 3C is a front elevational view of a movable barrier after a closing operation and before a pretensioning operation, and FIG. 3D is a front elevational view of a movable barrier after a pretensioning operation;

FIGS. 4A-4D are graphs of force applied to a flexible driven member as a function of time for different approaches to repositioning slack in the driven member wherein FIG. 4A is a graph of force applied to a flexible driven member with a substantially constant pretensioning force, FIG. 4B is a graph of force applied to a flexible driven member with a substantially constant pretensioning force following an initial delay, FIG. 4C is a graph of force applied to a flexible driven member with a momentary pretensioning force, FIG. 4D is a graph of force applied to a flexible driven member with a momentary pretensioning force following an initial delay;

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments. Also, common but well-understood elements that are useful or necessary in a commercially feasible embodiment are often not depicted to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Figure 1:
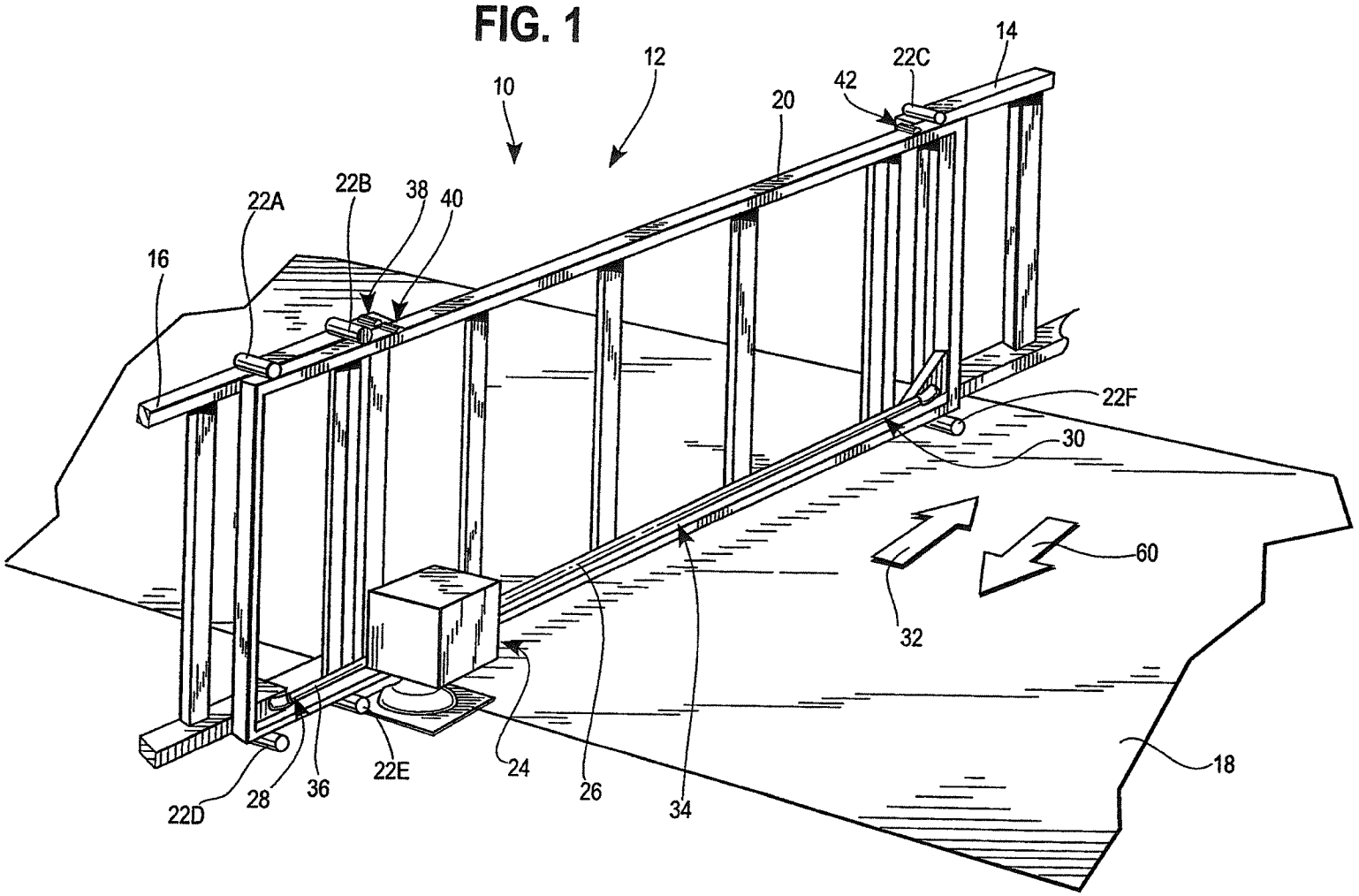
FIG. 1 is a perspective view of an example of a movable barrier operator system showing a movable barrier operator configured for controlling the position of a movable barrier by moving a flexible driven member connected to the movable barrier.

In FIG. 1, an example of a movable barrier system 10 is shown that controls access through an entrance 12 between portions of a fence 14, 16 disposed on opposite sides of a roadway 18. The movable barrier system 10 includes a movable barrier 20 that slides along rollers 22A-22F between a closed limit position (shown in FIG. 1) and an opened limit position (not shown) where a vehicle can pass through the entrance 12. Movable barrier system 10 includes a movable barrier operator 24 having a drive system that engages a flexible driven member 26 and adjusts the position of the flexible driven member 26 to control the position of the movable barrier 20. The flexible driven member 26 has opposed end portions 28, 30 connected to the movable barrier 20 and disposed on opposite sides of the movable barrier operator 24.

To shift the movable barrier 20 from the open limit position to the closed limit position in direction 32, the movable barrier operator 24 advances a leading portion 34 of the flexible driven member 26 in direction 32 while a trailing portion 36 of the driven member 26 is advanced toward the movable barrier operator 24. In one approach, the movable barrier system 10 includes a position sensor 38 that detects whether the movable barrier 20 has reached an open or closed limit position using electrical contacts 40, 42. Once the movable barrier 20 has reached the closed limit position (shown in FIG. 1), the effect of gravity may cause the leading portion 34 of driven member 26 to sag downwardly in an aesthetically unappealing manner.

Figure 2:
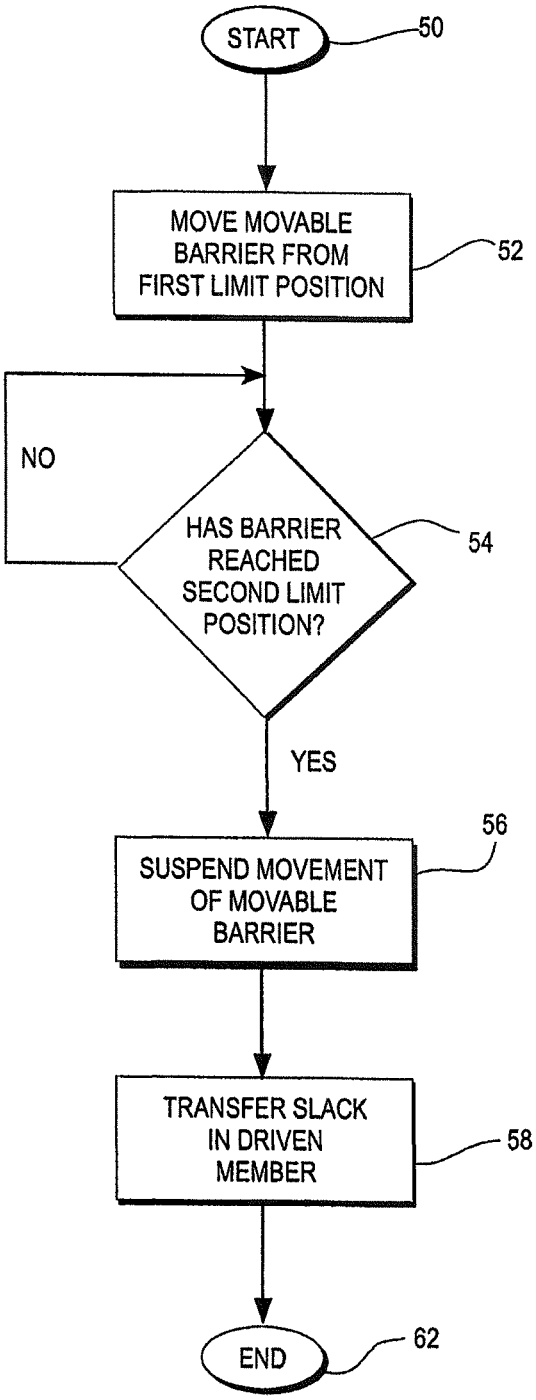
FIG. 2 is a flow chart of an approach to repositioning slack in a flexible driven member of FIG. 1.

One approach to reducing the amount of sag in the leading portion 34 of driven member 26 is illustrated by the flow diagram of FIG. 2. The example method starts at step 50 when the movable barrier 20 is at a first limit position, such as where the movable barrier 20 is in the open limit position. At step 52, the movable barrier operator 24 applies a force to the flexible driven member 26 sufficient to initiate movement of the movable barrier 20 in direction 32. The movable barrier operator 24 may monitor the position of the movable barrier 20 at step 54 as the movable barrier 20 travels from the first limit position to a second limit position, such as where the movable barrier 20 is in the closed limit position. Once the movable barrier 20 reaches the second limit position, the movable barrier operator 24 detects this arrangement via the proximity of the position sensor 38 to the contact 40. The movable barrier operator 24 then suspends movement of the movable barrier 20 by stopping application of force to the driven member 26 at step 56. A movable barrier system 10 may also include stops on the fence 14, 16 that limit movement of the movable barrier 20 beyond the first and second limit positions.

With the movable barrier 20 in the second limit position, the movable barrier operator 24 transfers slack in the driven member 26 at step 58 by reversing the direction of the drive system of the movable barrier operator 24 and advancing the leading portion 34 of the driven member 26 in direction 60 (see FIG. 1) such that the leading portion 34 of the driven member 26 is tensioned to remove slack therefrom. Transferring slack from the leading portion 34 to the trailing portion 36 causes the trailing portion 36 to sag downward a greater amount than before the drive system of the movable barrier operator 24 was reversed. At step 62, the leading portion 34 will sag a lesser amount and will therefore be more aesthetically pleasing had the method shown in FIG. 2 not been applied.

Figure 3A:
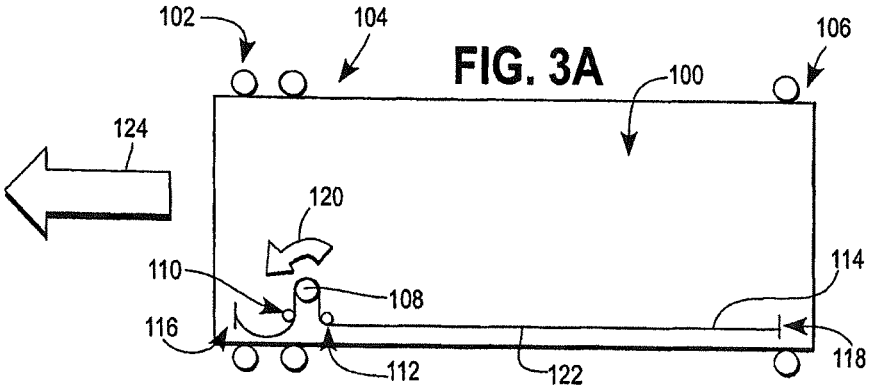

FIGS. 3A-3D illustrate an example of the method of FIG. 2 applied to a simplified movable barrier system. In FIG. 3A, a movable barrier 100 is configured to be shifted along rollers 102 between a first limit position 104 and a second limit position 106. The movable barrier 100 could also be configured to slide along a track, swing about an axis, or move vertically such as in the garage barrier operator context, as is apparent to one of skill in the art. A movable barrier operator (not shown) is positioned adjacent the movable barrier 100 with a rotatable drive 108 and a pair of pulleys 110, 112 of the movable barrier operator adapted to move the movable barrier 100 by applying a force to a flexible driven member 114. The flexible driven member 114 may, for example, comprise a cable, a tape, a rope, a chain, a belt, or a combination of these devices. The drive member 114 has opposed end portions 116, 118 connected to the movable barrier 100 and disposed on opposite sides of the rotatable drive 108. The driven member 114 is fed from below one of a pair of pulleys 110, 112, over the rotatable drive 108, and down below the other of the pair of pulleys 110, 112. The pulleys 110, 112 keep the driven member 114 traveling about a predetermined path and restrict the driven member 114 from disengaging from the rotatable drive 108.

In an alternative garage door opener system example (not shown), the driven member may have both ends thereof attached to a trolley of the garage door opener. A rotatable drive of the garage door operator may engage the driven member between the ends thereof. The garage door opener system may encounter similar slack issues delineated with respect to the embodiments shown in FIGS. 1 and 3A-3D such that it may be desirable to remove slack from one length of the driven member and transfer it to another length of the driven member. To this end, the rotatable drive of the garage door opener may be operated in a manner similar to the method illustrated in FIG. 2 to reposition slack in the driven member.

Figure 3B:
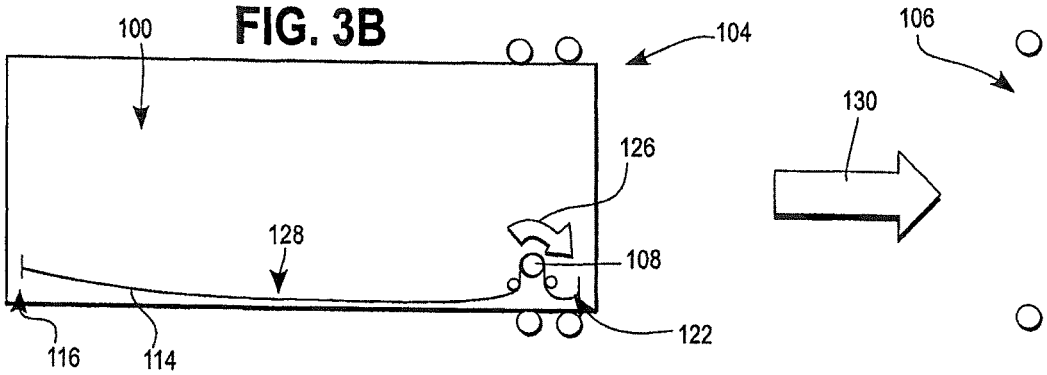
Figure 3C:
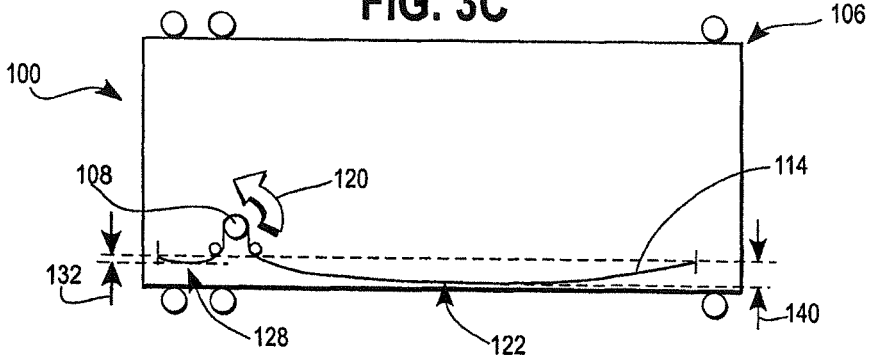

Returning to FIG. 3A, the rotatable drive 108 may be rotated in a direction 120 to apply a tensile force on a leading portion 122 and pull the end portion 118 and associated connection to the movable barrier 100 toward the rotatable drive 108. This shifts movable barrier 100 in a direction 124 toward the first limit position 104. As shown in FIG. 3B, reversing rotation of the rotatable drive 108 in a direction 126 applies a tensile force to a trailing portion 128 of the driven member 114 which pulls the end portion 116 of the driven member 114 and the associated connection with the movable barrier 100 in a direction 130. This shifts the movable barrier 100 toward the second limit position 106, as shown in FIG. 3C.

With the movable barrier 100 returned to the second limit position 106, the leading portion 122 of the driven member 114 sags downwardly a distance 140 due to the effect of gravity on the leading portion 122. The trailing portion 128 also sags downwardly a distance 132. The representation in FIG. 3C of the drooping driven member 114 is similar to existing movable barrier systems having flexible driven members wherein a long section of the flexible driven member sags downwardly and creates an aesthetically unappealing configuration. To address this shortcoming, the rotatable drive 108 is rotated in a direction 120 to apply a tensioning force to the leading portion 122 which transfers a length of the leading portion 122 to an opposite side of the rotatable drive 108 and into the trailing portion 128. This has the effect of transferring slack from the leading portion 122 to the trailing portion 128 such that the leading portion 122 sags downward a distance 144 that is less than the distance 140. In this manner, the leading portion 122 droops downwardly less than it did before rotation of the rotatable drive 108 in the direction 120. Conversely, rotation of the rotatable drive 108 in the direction 120 causes the trailing portion 128 to sag downwardly a distance 146 that is greater than the distance 132 shown in FIG. 3C. The leading portion 122 may be longer than the trailing portion 128 such that the leading portion 122 creates a visual focal point along the movable barrier 100. As such, it may be more visually appealing to have a short trailing portion 128 that sags downwardly a greater amount than a long leading portion 122 so that the overall appearance of the movable barrier 100 and the driven member 114 is improved.

Figure 3D:
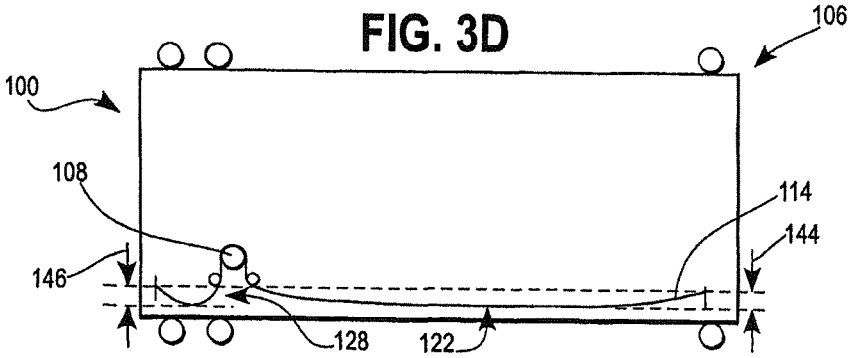

Turning to FIGS. 4A-4D, graphs are provided that illustrate the force applied to the driven member as a function of time. Each figure illustrates a different approach of a pretensioning method for repositioning slack in the driven member. Further, the graphs start at a time $T_0$ wherein the movable barrier arrives at a limit position such as a second limit position 106 as shown in FIGS. 3C and 3D. In the slack repositioning approach of FIG. 4A, the amount of force applied to the driven member ramps upwardly from a force value of zero. This sudden increase reflects the movement of rotatable drive 108 in FIG. 3C wherein the rotatable drive 108 begins to rotate in the direction 120 to remove slack from the leading portion 122 and to transfer the slack to the trailing portion 128. The force value, however, may begin at a non-zero amount and increase from that amount.

Returning to FIG. 4A, the drive of the movable barrier applies an increasing amount of force until a pretensioning force $F_P$ is reached, which represents a predetermined pretensioning force sufficient to transfer slack in the driven member without moving the movable barrier 100 from the second limit position 106. In one example, the pretensioning force $F_P$ is sufficient to resist the weight of a heavy driven member from being able to backdrive the rotatable drive and recreate slack. Further, the pretensioning force $F_P$ may be any amount of force up to a threshold force $F_T$, which is the force needed to overcome the inertia of the movable barrier 100 and begin movement of the movable barrier 100 toward the first limit position 104. In one example, the pretensioning force $F_P$ is approximately $1/10^{th}$ the threshold force $F_T$.

The movable barrier operator applies the pretensioning force $F_P$ until a time $T_1$, wherein the movable barrier operator receives a signal to shift the movable barrier 100 to the first limit position 104. At time $T_1$, the rotatable drive 108 applies an increasing amount of force to the driven member 114 until reaching the threshold force $F_T$ at time $T_2$. The movable barrier operator may include an upper limit on the amount of force the rotatable drive 108 may apply to the driven member 114, and the threshold force $F_T$ may be at or below the upper limit of that force. The rotatable drive 108 applies a decreasing amount of force after time $T_2$ until the time $T_3$, which reflects the lower amount of force needed to continue movement of the movable barrier 100 after the movable barrier 100 has initially shifted away from the second limit position 106. Specifically, the rotatable drive 108 applies a barrier movement force $F_M$ at $T_3$ to continue movement of the movable barrier 100 after the threshold force of $F_T$ has initiated movement of the movable barrier 100. For a given arrangement, the barrier movement force $F_M$ may be the same as the threshold force $F_T$. The force applied to the driven member 114 rapidly decreases to zero at a time $T_4$ after the movable barrier 100 has reached the first limit position 104. Alternatively, the force applied to the driven member 114 could decrease to a non-zero amount.

Figure 4A:
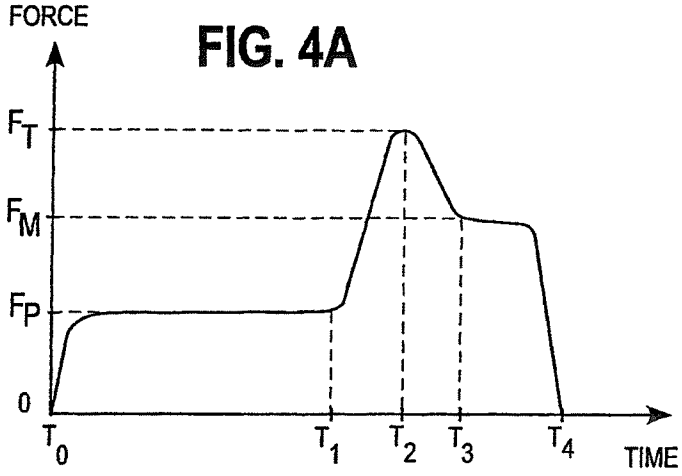
Figure 4B:
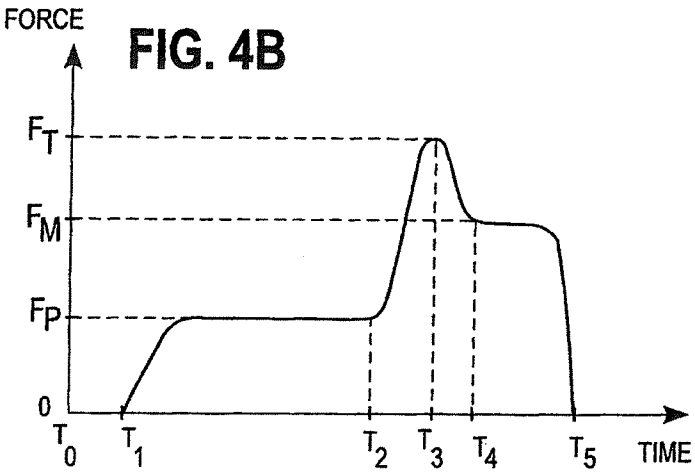

An alternative method for repositioning slack includes a delay period between the time $T_0$ and a time $T_1$, as shown in FIG. 4B. This delay reflects a passage of time after the movable barrier 100 has reached the second limit position 106, as shown in FIG. 3C. In one form, the delay in time between time $T_0$ and $T_1$ may be between approximately 0.1 and approximately 5 seconds. This delay may provide a time period for the driven member to come to a rest after moving the barrier, which can reduce the amount of noise or movement produced when the pretensioning force $F_P$ is applied. At time $T_1$, the rotatable drive 108 applies an increasing amount of force until the pretensioning force $F_P$ is reached. The rotatable drive 108 rotates in the direction 120 to apply the pretensioning force $F_P$ to transfer slack from the leading portion 122 to the trailing portion 128 without moving the movable barrier 100 from the second limit position 106. At time $T_2$, the movable barrier operator receives a signal to shift the movable barrier 100 away from the second limit position 106. The rotatable drive 108 then applies an increasing amount of force against the driven member 114 until the force reaches threshold force $F_T$. The subsequent force applied to the driven member 114 between time $T_3$ and time $T_5$ is similar to the method discussed above with respect to FIG. 4A.

Figure 4C:
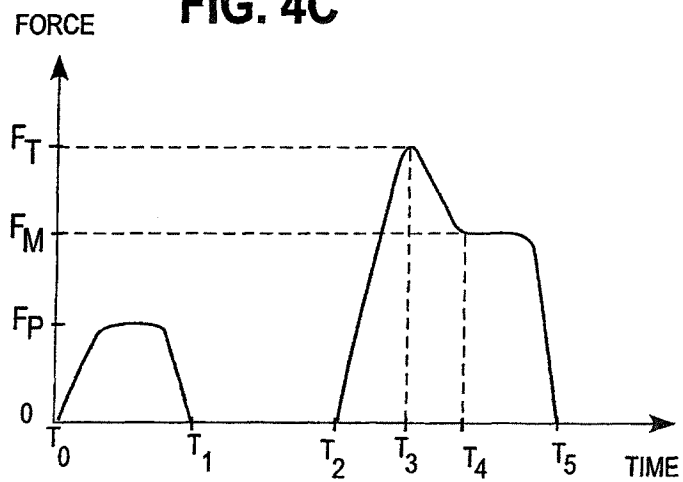
Figure 4D:
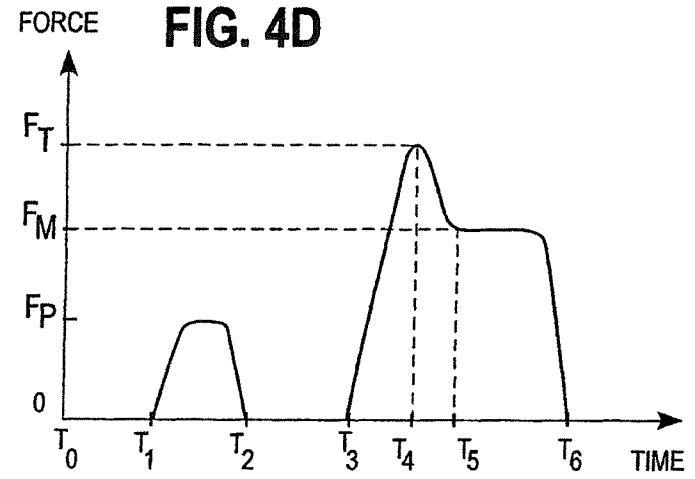

Turning to FIGS. 4C and 4D, alternative slack positioning methods are illustrated that utilize a burst of force applied to the driven member 114 to reposition slack therein. More specifically, the rotatable drive 108 applies a burst of force to the driven member 114 during an initial time period followed by little or no force during a subsequent time period. The force $F_P$ may be equivalent to the force $F_P$ in FIGS. 4A and 4B that tensions the leading portion 122 to remove slack therefrom while being less than a threshold force $F_T$ needed to move the movable barrier 100 away from the second limit position 106. In the approach of FIG. 4C, the rotatable drive 108 does not apply force to the driven member 114 between times $T_1$ and $T_2$. At time $T_2$, the movable barrier operator begins to move the movable barrier 100 away from second limit position 106 by applying an increasing amount of force until reaching the threshold force $F_T$ at which the movable barrier 100 begins to move toward the first limit position 104. The subsequent application of force to the driven member 114 between times $T_3$ and $T_5$ is similar to the approaches described above with respect to FIGS. 4A and 4B.

There may also be a delay between the movable barrier 100 arriving at the second limit position 106 and the subsequent repositioning of slack within the driven member 114, as shown in FIG. 4D. For example, the rotatable drive 108 may not apply force against the driven member 114 until the time $T_1$ which may be between approximately 0.1 seconds and approximately 5 seconds after the movable barrier 100 arrives at the second limit position 106. The rotatable drive 108 may then apply the pretensioning force $F_P$ against the driven member 114 at time $T_1$ until time $T_2$. At time $T_3$, the rotatable drive 108 applies an increasing amount of force until reaching the threshold force $F_T$ at which the movable barrier 100 begins to move away from the second limit position 106. The subsequent application of force to the driven member 114 at times $T_4$, $T_5$, and $T_6$ is similar to the approaches discussed above with respect to times $T_3$, $T_4$, and $T_5$ of FIGS. 4A-4C.

As with the approaches of FIGS. 4A and 4B, the burst of force in FIGS. 4C and 4D are sufficient to remove slack from the leading portion 122 of the driven member 114. After the burst of force, the weight of the trailing portion 128 may be sufficient to restrict rotation of the rotatable drive 108 that would permit slack in the trailing portion 128 to transfer back to the leading portion 122 until a time $T_2$ (FIG. 4C) or $T_3$ (FIG. 4D). The rotatable drive 108 may also have frictional forces or an applied brake that resist rotation of the rotatable drive 108 and further restrict slack in the trailing portion 128 from transferring back to the leading portion 122.

Figure 5:
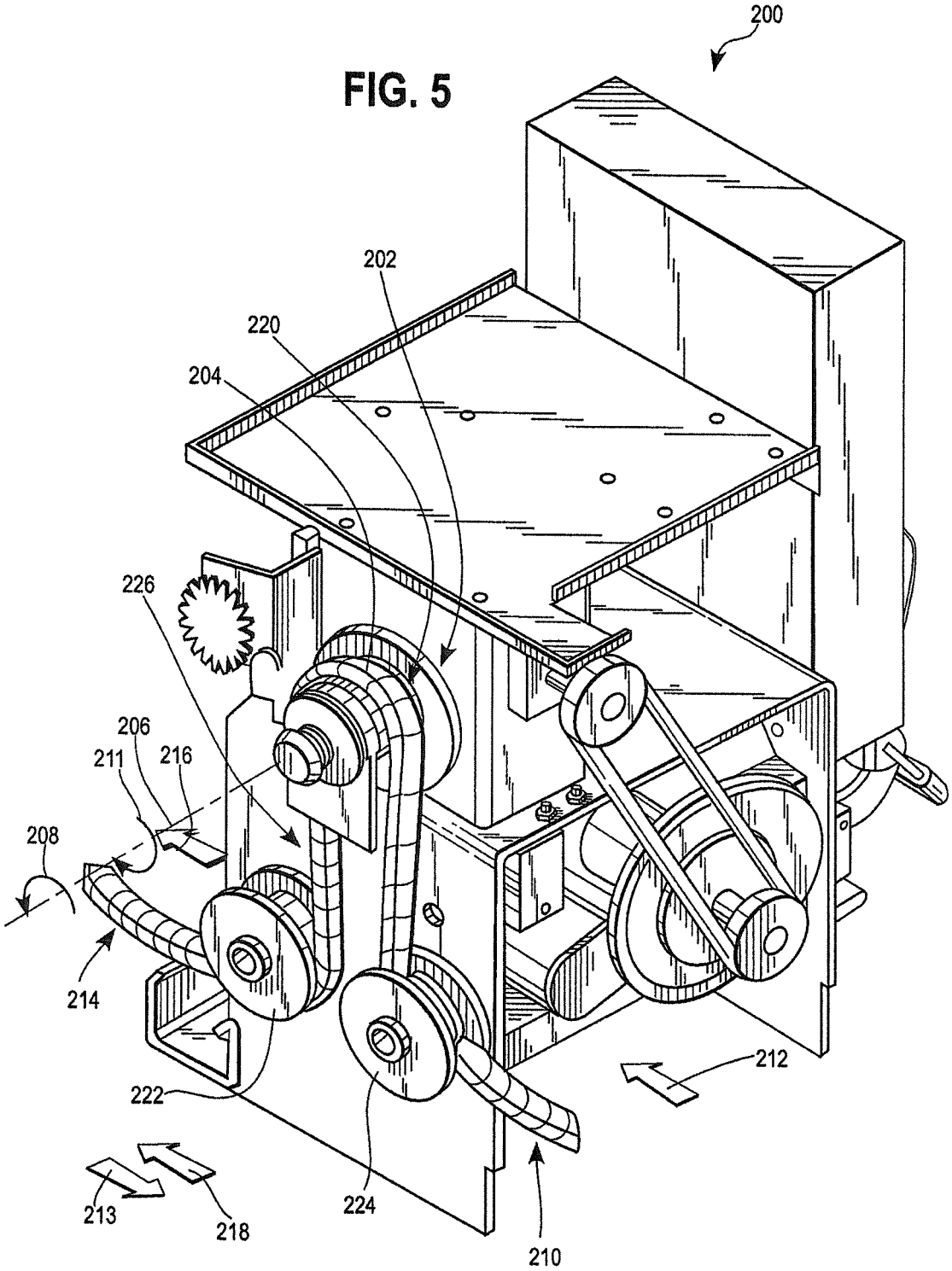
FIG. 5 is a perspective view of an example movable barrier operator showing a flexible driven member engaged with a rotatable drive of the movable barrier operator.

In FIG. 5, an example of a movable barrier operator 200 is shown. The movable barrier operator 200 has a rotating drive 202 that engages a flexible driven member 204 and rotates around an axis 206. In the illustrated example, the rotating drive 202 comprises a gear and the flexible driven member 204 comprises a chain. Rotating the drive 202 in a direction 208 draws a trailing portion 210 of the driven member 204 in direction 212 toward the rotating drive 202. Rotation of the drive 202 in the direction 208 also causes a leading portion 214 to be paid out from the rotating drive 202 in a direction 216. The flexible driven member 204 may be connected at opposite ends to a movable barrier (not shown) such that rotation of the drive 202 in direction 208 causes the movable barrier to shift in direction 218.

The movable barrier operator 200 may also include a position sensor 220 that monitors the position of the rotating drive 202 so that the position of the movable barrier can be determined. One such position sensor 220 is disclosed in U.S. Pat. No. 6,400,112 to Fitzgibbon et al., which issued on Jun. 4, 2002, the contents of which are hereby incorporated by reference in their entirety. Specifically, the position sensor 220 may include a pass-point system driven by a motor shaft of the movable barrier operator 200. The pass-point system employs a plurality of spur gears disposed on a common shaft, with each gear having an aperture and a different number of teeth. The spur gears are driven by a common pinion at slightly different speeds such that the apertures of the gears align only once during movement of the associated movable barrier between limit positions. The pass-point system may utilize an optical emitter and an optical detector to determine when the apertures of the spur gears are aligned. A pass-point occurs when all the apertures align, and the pass-point system may use the pass-point as a reference point to measure barrier travel beyond the pass-point and toward the limit positions.

The movable barrier operator 200 of FIG. 5 also includes pulleys 222, 224 that keep the driven member 204 tightly engaged with the rotating drive 202. In one aspect, the movable barrier operator 200 may rotate the drive 202 in a direction 211 to remove slack from leading portion 214. Rotating the drive 202 in the direction 211 tensions a portion 226 of the driven member 204 so that when the movable barrier operator 200 initiates movement of the movable barrier in a reverse direction 213, the portion 226 of the driven member 204 will be tightly engaged with the rotating drive 202. This may reduce the damage or wear that can occur to the movable barrier operator 200 when the flexible driven member 204 is loosely engaged with the drive 202 and the drive is rapidly rotated in the direction 208 to shift a movable barrier in the direction 218.

Figure 6:
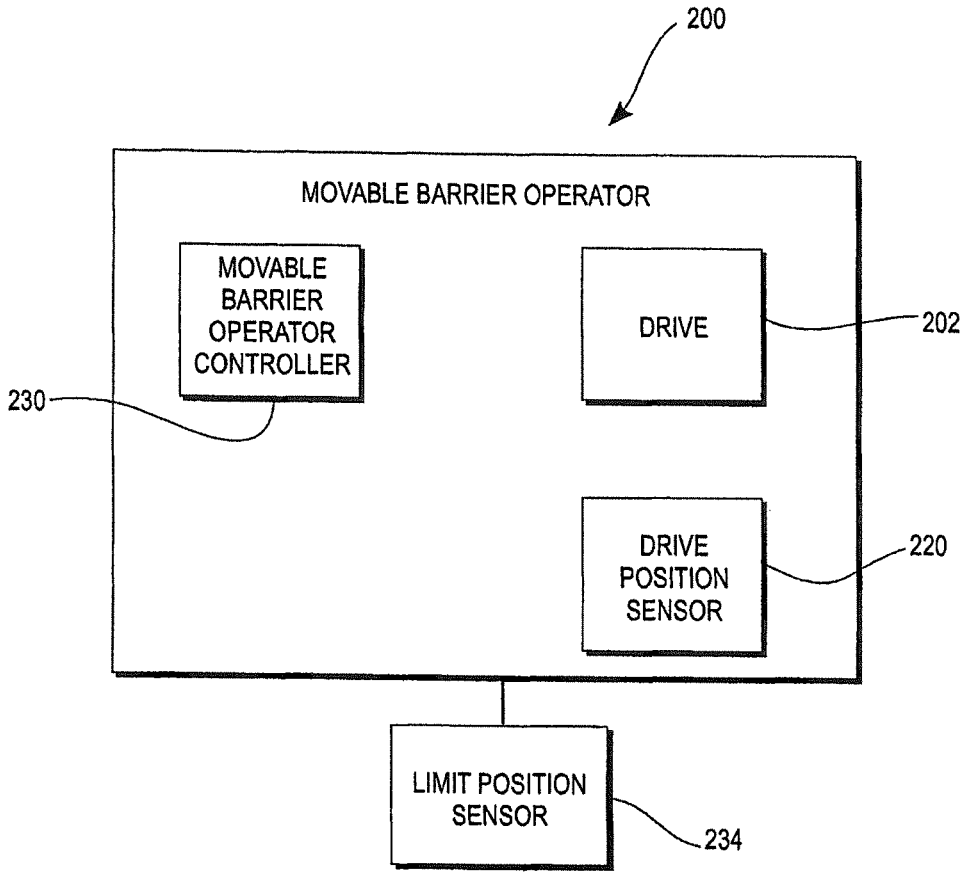
FIG. 6 is a block diagram of the movable barrier operator of FIG. 5 showing selected components of the movable barrier operator.

Referring to FIG. 6, the movable barrier operator 200 may include a movable barrier operator controller 230 that is in communication with the drive position sensor 220 of the movable barrier operator 200. The movable barrier operator controller 230 may monitor the position of the movable barrier via the drive position sensor 220 and/or a limit position sensor 234. In response to the movable barrier operator controller 230 determining that the movable barrier has reached a limit position, the movable barrier controller 230 may cause the movable barrier operator 200 to move the driven member 204 in a reverse direction to remove slack from one of the portions 210, 214, as described above. To this end, the movable barrier operator controller 230 may control the position of the drive 202 to control the position of the associated movable barrier. Those skilled in the art will recognize and appreciate that such a controller 230 can comprise a fixed-purpose hard-wired platform or can comprise a partially or wholly programmable platform. All of these architectural options are well known and understood in the art and require no further description here.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A movable barrier apparatus comprising:

a flexible driven member having a leading portion and a trailing portion each of which is configured to connect to a movable barrier which is configured to move between a first limit position and a second limit position;

a movable barrier operator comprising a revolving drive, the revolving drive disposed between the leading and trailing portions of the flexible driven member and configured to rotate about an axis causing the leading portion of the flexible driven member to move in a forward direction which causes the leading portion to be paid out from the revolving drive, the trailing portion to be pulled toward the revolving drive and the movable barrier to move toward the first limit position, the movable barrier operator further configured to move the leading portion of the flexible driven member in a reverse direction opposite to the forward direction by moving the leading portion of the flexible driven member toward the revolving drive while moving the trailing portion of the flexible driven member away from the revolving drive to move the movable barrier laterally along a horizontal surface toward the second limit position, wherein the movement of the trailing portion of the flexible driven member away from the revolving drive effects a horizontal force on the movable barrier to effect the movement of the movable barrier toward the second limit position during all of the movement of the movable barrier toward the second limit position, wherein the movable barrier operator is configured to stop moving the movable barrier in response to the movable barrier arriving at the first or second limit positions, wherein the leading portion of the flexible driven member extends along a majority of a length of the movable barrier when said movable barrier is in said first limit position and the trailing portion extends along a portion of the length of the movable barrier, the length extending along the horizontal surface; and a movable barrier controller operatively coupled to the movable barrier operator, the movable barrier controller being configured to cause the revolving drive of the movable barrier operator to move the leading portion of the flexible driven member in the reverse direction a distance toward the revolving drive by rotating the revolving drive about the axis when the movable barrier is in the first limit position without moving the movable barrier to reduce sag in the leading portion of the flexible driven member.

2. The movable barrier apparatus of claim 1 further comprising at least one limit position sensor configured to sense when the movable barrier arrives at the first limit position, wherein the movable barrier controller is configured to move the leading portion of the driven member in the reverse direction the distance in response to the at least one limit position sensor detecting that the movable barrier is in the first limit position.

3. The movable barrier apparatus of claim 1 further comprising:

a position sensor configured to detect a position of the revolving drive;

wherein the movable barrier controller is operatively coupled to the revolving drive and the position sensor, the movable barrier controller being configured to calculate a position of the movable barrier in response to information from the position sensor, wherein the movable barrier controller is configured to cause the movable barrier operator to move the leading portion of the driven member in the reverse direction the distance when the movable barrier controller determines that the revolving drive has moved the movable barrier to the first limit position.

4. The movable barrier apparatus of claim 1 wherein the driven member is created from one or more of the group consisting of: a cable, a tape, a rope, a chain, and a belt.

5. The movable barrier apparatus of claim 1 wherein the movable barrier operator is configured to apply a sag reducing force to the flexible driven member that is less than a threshold force needed to overcome an inertia of the movable barrier.

6. The movable barrier apparatus of claim 5 wherein the movable barrier controller is configured to cause the movable barrier operator to apply the sag reducing force to the flexible driven member until a next operation of the movable barrier operator.

7. The movable barrier apparatus of claim 5, wherein the movable barrier controller is configured to cause the movable barrier operator to apply said sag reducing force to the flexible driven member substantially constantly until receiving a signal.

8. The movable barrier apparatus of claim 5 wherein the sag reducing force is applied to the flexible driven member after a delay time period has elapsed, the delay time period is started in response to the movable barrier reaching the first limit position.

9. The movable barrier apparatus of claim 8 wherein the delay time period is greater than one second.

10. The movable barrier apparatus of claim 1 wherein the movable barrier controller is configured to cause the movable barrier operator to move the leading portion of the flexible driven member in the reverse direction so that the sag in the leading portion of the flexible driven member is transferred to the trailing portion of the flexible driven member.

11. The movable barrier apparatus of claim 1 wherein the movable barrier controller is configured to cause the movable barrier operator to move the leading portion of the flexible driven member in the reverse direction for a fixed length of time.

12. The movable barrier apparatus of claim 11 wherein the fixed length of time is less than one second.

13. A movable barrier apparatus comprising:

a driven member configured to connect to a movable barrier configured to move between a first limit position and a second limit position;

at least one limit position sensor;

a movable barrier operator comprising a revolving drive, the revolving drive disposed to drive the driven member in a first direction to move the movable barrier toward the first limit position;

a movable barrier operator controller configured to receive a signal from the at least one limit position sensor, said limit position sensor generating said signal in response to the movable barrier reaching the first limit position, the movable barrier operator controller further configured to suspend the driving of the driven member in response to receiving the signal from the at least one limit position sensor;

wherein the movable barrier operator controller is further configured to control the movable barrier operator to apply a pretensioning force to the driven member to move the driven member in a second direction opposite to said first direction without overcoming an inertia of the movable barrier which pretensions the driven member between the revolving drive of the movable barrier operator and a connection between barrier, said pretensioning force is threshold force that would overcome the inertia of the movable barrier.

14. The movable barrier apparatus of claim 13 wherein the movable barrier controller is configured to cause the movable barrier operator to move the driven member in the second direction for a fixed length of time.

15. The movable barrier apparatus of claim 14 wherein the fixed length of time is less than one second.

16. The movable barrier apparatus of claim 13 wherein the movable barrier operator controller is further configured to control the movable barrier operator to apply the pretensioning force to the driven member substantially constantly until receiving a signal to move the movable barrier.

17. The movable barrier apparatus of claim 13 wherein the movable barrier controller is configured to cause the movable barrier operator to apply the pretensioning force to the driven member until the movable barrier operator is further operated.

18. The movable barrier apparatus of claim 13 wherein the pretensioning force is applied to the driven member after a delay time period has elapsed, the delay time period is started in response to the movable barrier reaching the first limit position.

19. The movable barrier apparatus of claim 18 wherein the delay time period is greater than one second.

* * * * *

UNITED STATES PATENT AND TRADEMARK OFFICE

CERTIFICATE OF CORRECTION

PATENT NO. : 9,010,026 B2
APPLICATION NO. : 14/258474
DATED : April 21, 2015
INVENTOR(S) : James Scott Murray et al.

It is certified that error appears in the above-identified patent and that said Letters Patent is hereby corrected as shown below:

IN THE CLAIMS:

Column 12, Claim 13, Line 3: After “between” insert -- the driven member and the movable --; and Column 12, Claim 13, Line 4: After “is” insert -- less than a --.

Signed and Sealed this
First Day of March, 2016

Michelle K. Lee

Michelle K. Lee
*Director of the United States Patent and Trademark Office*